US005273017A

United States Patent [19]

Braun et al.

[11] Patent Number: 5,273,017

[45] Date of Patent: Dec. 28, 1993

[54] FUEL INJECTION PUMP FOR INTERNAL COMBUSTION ENGINES

[75] Inventors: Wolfgang Braun, Ditzingen; Dieter Junger, Stuttgart; Helmut Laufer, Gerlingen, all of Fed. Rep. of Germany

[73] Assignee: Robert Bosch GmbH, Stuttgart, Fed. Rep. of Germany

[21] Appl. No.: 860,511

[22] Filed: Jun. 11, 1992

[30] Foreign Application Priority Data

Oct. 11, 1990 [DE] Fed. Rep. of Germany ..... 4032279

[51] Int. Cl.[5] ..... F02M 37/04

[52] U.S. Cl. ..... 123/506; 123/449

[58] Field of Search ..... 123/506, 458, 449, 503

[56] References Cited

U.S. PATENT DOCUMENTS

| | | | |
|---|---|---|---|
| 4,385,614 | 5/1983 | Eheim | 123/506 |
| 4,437,444 | 3/1984 | Yasuhara | 123/458 |
| 4,480,619 | 11/1984 | Igashira | 123/458 |
| 4,530,337 | 7/1985 | Laufer | 123/506 |
| 4,838,233 | 6/1989 | Hayashi | 123/506 |
| 4,971,012 | 11/1990 | Brunnel | 123/506 |
| 5,033,443 | 7/1991 | Kato | 123/506 |
| 5,115,783 | 5/1992 | Nakamura | 123/506 |

FOREIGN PATENT DOCUMENTS

| | | |
|---|---|---|
| 3211680 | 10/1983 | Fed. Rep. of Germany . |
| 3500618 | 7/1985 | Fed. Rep. of Germany . |
| 3612942 | 10/1987 | Fed. Rep. of Germany . |
| 3719833 | 12/1988 | Fed. Rep. of Germany . |
| 3721352 | 1/1989 | Fed. Rep. of Germany . |

OTHER PUBLICATIONS

Patent Abstracts of Japan, vol. 9, No. 313, 10 Dec. 1985 & JP, A 60 147 544, Mar. 8, 1983.

*Primary Examiner*—Carl S. Miller

*Attorney, Agent, or Firm*—Michael J. Striker

[57] ABSTRACT

A fuel injection pump for internal combustion engines comprises a suction space, a fuel duct, an electrically actuated valve controlling the fuel duct, a fuel supply tank, a distributor having a distributing opening, a plurality of pressure ducts connectable with injection locations of an internal combustion engine via injection lines, a pump plunger which defines a pump work space connectable with the suction space during a suction stroke and during a control portion of the delivery stroke of the pump plunger via the fuel duct, while fuel is delivered from the fuel supply tank to the suction space connectable during a respective delivery stroke of the pump plunger via the distributor opening with one of the plurality of pressure ducts. The valve has a closing phase which determines a high pressure fuel delivery into the injection lines, a fuel return, and a bypass line is provided to a fuel return and branches from the fuel duct between the suction space and the valve.

4 Claims, 2 Drawing Sheets

FUEL INJECTION PUMP FOR INTERNAL COMBUSTION ENGINES

BACKGROUND OF THE INVENTION

The present invention relates to fuel injection pumps for internal combustion engines.

More particularly it relates to a fuel injection pump for internal combustion engines having a pump plunger which defines a pump work space connectable with a suction space during a suction stroke and during a controlled portion of a delivery stroke of the pump plunger via a fuel duct controlled via an electrically actuated valve, wherein fuel being delivered from a fuel supply tank to the suction space is connectable during the respective delivery stroke of the pump plunger via a distributor opening in a distributor with one of a plurality of pressure ducts.

Such a fuel injection pump is known from DE-OS 37 19 833. In this instance, the pump work space is filled and relieved before the start and after the end of the high-pressure delivery via the fuel duct. The disadvantage of this design consists in that the fuel which is heated beforehand when high pressure is built up in the pump work space and which is controlled via the valve for terminating the high-pressure injection is supplied again to the pump work space during the subsequent suction stroke, at least to the extent that fuel is present in the fuel duct. The temperature of the pump work space accordingly increases, resulting in a high temperature loading of the magnet valve on the one hand and on the other hand in load-dependent and speed-dependent fluctuations in density because the fuel which is taken in varies in temperature. Further, such an increase in temperature in the pump work space leads to greater leakage losses and lower compression pressure due to the reduced filling density, which has a negative effect on the output determined by construction. It is also suggested in DE-OS 36 12 942 generally to cool the valve. This known fuel injection pump has a plurality of pump plungers which define a pump work space. During a suction stroke of the pump plungers the pump work space can be connected with a suction space in which fuel is delivered from a fuel supply tank. During a compression stroke of the pump plungers the pump work space can be connected with one of a number of pressure ducts which are connected via injection lines with the locations where fuel is injected into the internal combustion engine. The pump work space can be connected with a relief space via an electrically controlled valve. The pump plunger stroke effecting the injection is controlled by the valve. Fuel flows out of the suction space, through an interior space of the valve and into the pump work space to cool the valve. When relieved the fuel flows off through a pressure space of the valve. Fuel flows through the interior space of the valve and a cooling of the valve is effected accordingly only during the suction stroke of a pump plunger.

SUMMARY OF THE INVENTION

Accordingly, it is an object of the present invention to provide a fuel injection pump for an internal combustion engines, which avoids the disadvantages of the prior art.

In keeping with these objects and with others which will become apparent hereinafter, one feature of the present invention sides, briefly stated, in a fuel injection pump for internal combustion engines of the above mentioned type in which a bypass line to a fuel return branches from a fuel duct between the suction space and the valve.

When the fuel injection pump is designed in accordance with the present invention, it invention with the has the advantage that there is a continuous flow through the fuel duct which accordingly improves the cooling of the valve, and the temperature of the fuel which is sucked in is lowered while avoiding the disadvantages mentioned in the beginning.

In accordance with another feature of the present invention the valve is inserted in a bore hole in a housing part of the fuel injection pump, and together with the bore hole, defines an annular space which is connected with the bypass line and with the fuel return.

Still a further feature of the present invention is that a throttle is provided downstream of the branching of the bypass line of the fuel duct. In this construction the amount of fuel flowing off through the bypass can be fixed in a determined manner by corresponding dimensioning of the throttle.

In accordance with another feature of the present invention the pump work space is defined at its circumference by a cylinder bush which is arranged in the bore hole of the housing part, and an annular space is formed between the bore hole and the cylinder bush and is connected with the suction space on one side and with the valve on the other side, and the bypass line branches on the annular space enclosing the cylinder bush. With such a construction, a cooling of the pump work space is performed so that higher pressures can be achieved when the compression of the fuel, and the temperature of the fuel flowing off via the vale is reduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
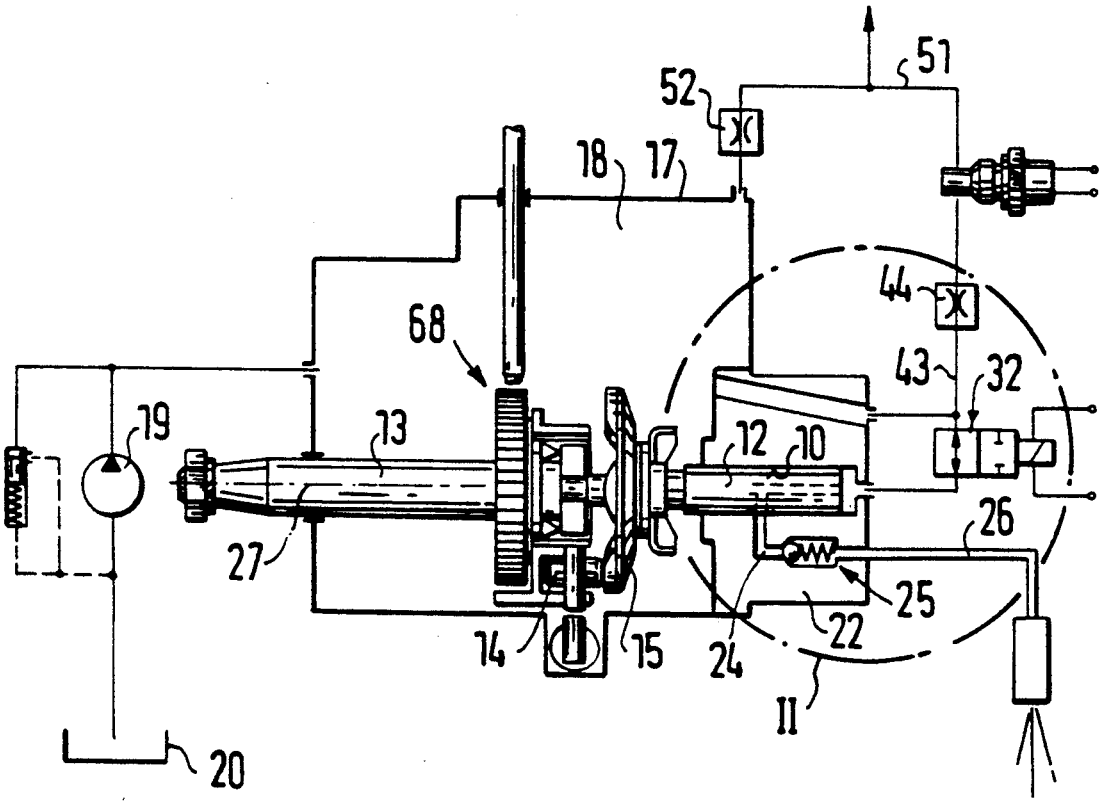
FIG. 1 is a schematic view of a fuel injection pump in longitudinal section and FIG. 2 is an enlarged view of the section of the fuel injection pump designated by II in FIG. 1.
Figure 2:
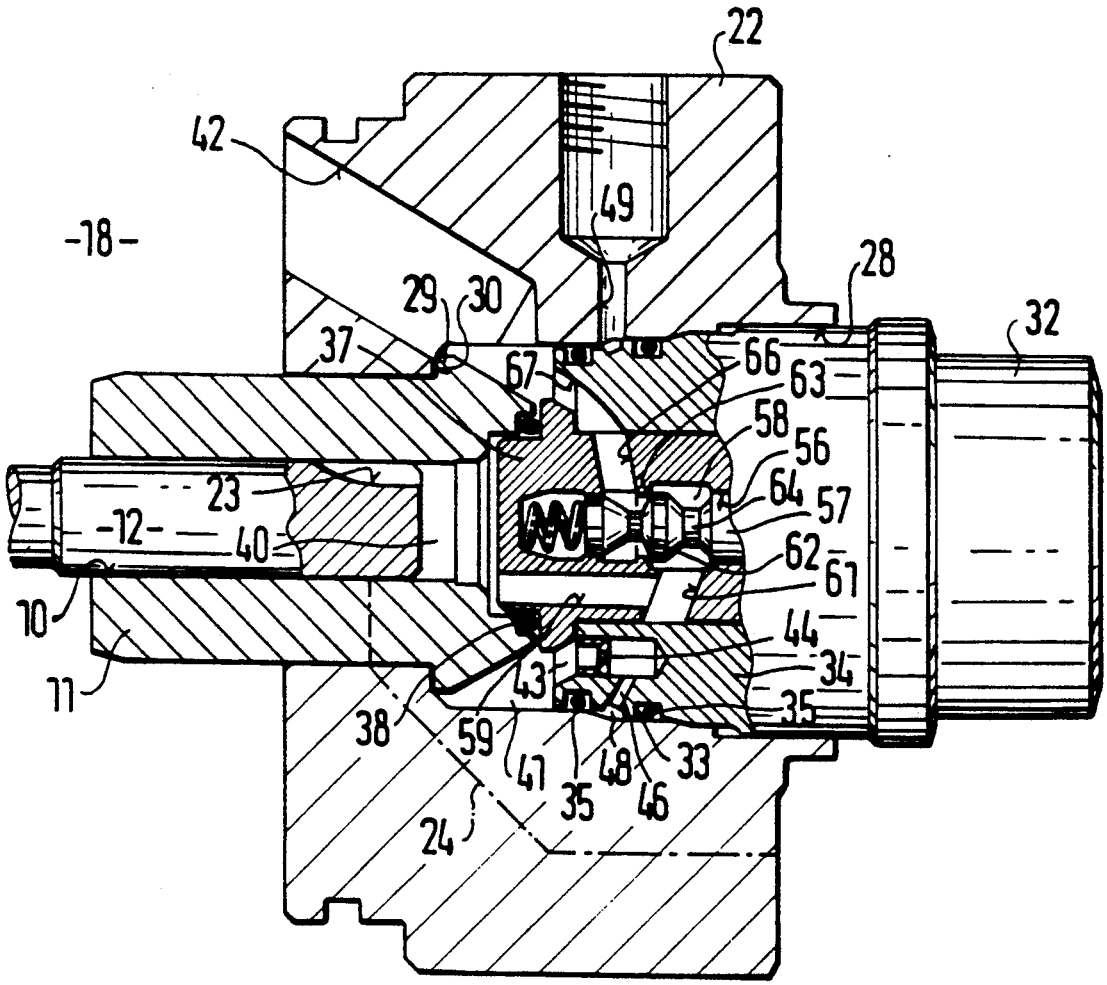

A distributor-type fuel injection pump shown in FIGS. 1 and 2 has a pump plunger 12 working in a cylinder bore 10 of a cylinder bush 11. The pump plunger 12 is set in reciprocating motion and in rotating motion simultaneously via a drive shaft 13 of a cam drive having a roller ring 14 and a spur-cam disk 15. The fuel injection pump has a housing 17 which defines an interior space 18 serving as a suction space and to which fuel is delivered by a delivery pump 19 from a supply tank. On a front side of the housing 18 a distributor body 22 is inserted into the housing. The pump plunger 12 is provided with a distributor groove 23 in its end area arranged in the cylinder bore 10. The cylinder bush 11 and the distributor body 22 have delivery ducts 23 corresponding to the number of cylinders of the internal combustion engine operated by the fuel injection pump. Fuel can reach the injection valves at the cylinders of the internal combustion engine via a pressure valve 25 and injection lines 26 through these delivery ducts 24.

The distributor body 22 has a stepped bore hole 28 extending coaxially relative to the longitudinal axis 27 of the pump plunger 12. The cylinder bush 11 is inserted into the bore hole 28 in its area of smaller diameter which faces the interior 18 space. The cylinder bush 11 projects into the interior space 18 of the fuel injection pump and is supported toward the interior space 18 by a flange 29 at an annular shoulder 30 formed at the transition of the bore hole 28 to the smaller diameter. The end of the flange 29 of the cylinder bush 11 arranged in the area of the bore hole 28 with the larger diameter is constructed in a conical manner with a cross section which decreases in diameter toward its end. The cylinder bore 10 has an increased diameter in the end area of the cylinder bush 11 arranged in the bore hole 28.

An electrically controlled valve 32 which closes the bore hole 28 is inserted from the outside in the area of the greater diameter of the bore hole 28. The valve 32 is constructed e.g. as a magnet valve. The bore hole 28 is sealed toward the outside by two sealing rings 35 which are inserted at a distance from one another in an annular groove 33 at the outer circumference of the valve housing 34. A valve body 37 whose end area projects out of the valve housing toward the cylinder bush 11 and which clamps a sealing ring 38 between itself and the cylinder bush 11 is inserted into the valve housing 34. The sealing ring 38 is fitted radially with slight play into a relief, which is preferably arranged in the cylinder bush 11, and can accordingly absorb radial forces occurring as a result of the application of pressure and accordingly seals a pump work space 40 toward the bore hole 28. The pump work space 40 is enclosed on the other side by the pump plunger 12 in the cylinder bore 10. As a result of this design an annular space 41 is defined between the end of the cylinder bush 11, the valve body and the valve housing 34. The annular space 41 is connected with the interior space 18 of the fuel injection pump via a fuel duct 42 in the distributor body 22. A bypass line 43 which extends approximately parallel to the longitudinal axis 27 of the pump plunger diametrically opposite the duct 42 and in which a throttle 44 is arranged leads from the annular space 41 through the valve housing 34. The bypass line 43 opens into an annular space 48 formed by an annular groove in the outer circumference of the valve housing 34 arranged between the sealing rings 35 and the wall of the bore hole 28 via a short transverse bore hole 46. The annular space 48 communicates in turn with a transverse bore hole 49 in the distributor body 22. The transverse bore hole 49 in the distributor body 22 is connected via a return line 51 with the fuel supply tank 20 or the suction line of the delivery pump 19. The interior space 18 of the fuel injection pump is likewise connected in a known manner with the fuel return line 51 via a throttle 52.

The valve 32 has a needle 57 as closing element, which needle 57 is tightly guided into a pocket bore hole 56 in the valve body 37. The pocket bore hole 56 has an area with enlarged cross section which forms a pressure space 58. The pressure space 58 of the valve 32 is connected with the pump work space 40 via a transverse bore hole 61 and a longitudinal bore hole 59 in the valve body 37. The needle 57 has a conical sealing surface 62 toward the work space which cooperates with a sealing seat 63 of the pocket bore hole 56 at the transition from the pressure space 58 to the pocket bore hole, which sealing seat 63 is likewise conical. The needle 57 has an area 64 with reduced cross section in the pressure space 58. The pressure prevailing in the pump work space 40 acts on the two front sides of the area 64 of the needle 57 in the pressure space 58 so that no resultant pressure force acts on the latter. When the needle 57 is lifted off, the pump work space 40 is connected with the annular space 41 via the bore hole 59, the transverse bore hole 61, the pressure space 58, another transverse bore hole 66 in the valve body 37, and an opening 67 in the valve housing 34 and is connected with the interior space 18 via the annular space 41 and the fuel duct 42.

The opening and closing periods and the opening and closing times of the valve 34 are controlled as a function of the various operating parameters, e.g. speed, load, etc. A rotation transmitter 68 is provided for detecting the speed and the rotational position of the drive shaft 13. During the suction stroke of the pump plunger 12, the valve 32 is opened and the fuel which is under delivery pressure of the delivery pump flows out of the interior space 18 through the duct 42, the annular space 41, the valve 32 and the longitudinal bore hole 59 into the pump work space 40. At a determined time during the delivery stroke of the pump plunger 12, the valve 32 is closed and high pressure is built up in the pump work space 40. In a determined rotational position of the pump plunger 12, the distributor groove 23 is connected with one of the delivery ducts 24 and fuel flows to the respective point of injection under high pressure as soon as the injection valve is opened. To terminate the high-pressure delivery the valve 32 is opened and the fuel flows out of the pump work space 40 through the valve 32 into the annular space 41. From there, a portion of the fuel flows back into the interior space 18 through the fuel duct 42. Another portion of the fuel flows through the throttle 44 into the additional annular space 48, flows through the latter and the transverse bore hole 49 in the distributor body 22 and arrives back in the fuel supply tank 20 via the return line 51. Moreover, fuel flows constantly out of the interior space 18 via the annular space 41, the throttle 44 and the annular space 48, since the fuel pressure prevailing in the interior space 18 is higher than that in the return line 51. Cooler fuel from the interior space flows through the valve 32 and the cylinder bush in the area of the pump work space 40 and accordingly cools the latter as a result of the fuel flow through the two annular spaces 41 and 48. The heated fuel flowing out of the work space subsequent to the fuel injection phase is supplied again to the pump work space during the suction stroke to a much smaller extent. The fuel flow flowing through the annular spaces 41 and 48 can be adjusted to achieve a desired cooling by dimensioning and adapting the throttles 44 and 52 in a corresponding manner.

It will be understood that each of the elements described above, or two or more together, may also find a useful application in other types of constructions differing from the types described above.

While the invention has been illustrated and described as embodied in a fuel injection pump for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it of various applications without omitting features that, from the standpoint of prior art, fairly constitute essential characteristics of the generic or specific aspects of this invention.

What is claimed as new and desired to be protected by Letters Patent is set forth in the appended claims.

1. A fuel injection pump for internal combustion engines, comprising means forming a suction space; a fuel duct; and electrically actuated valve controlling said fuel duct; a fuel supply tank; a distributor having a distributing opening; a plurality of pressure ducts connectable with injection locations of an internal combustion engine via injection lines; a pump plunger which defines a pump work space connectable with said suction space during a suction stroke and during a control portion of the delivery stroke of said pump plunger via said fuel duct, while fuel is delivered from said fuel supply tank to said suction space connectable during a respective delivery stroke of said pump plunger via said distributor opening with one of said plurality of pressure ducts and during the suction stroke of fuel is sucked form said suction space into said pump working space, said valve having a closing phase which determines a high pressure fuel delivery into said injection lines and opens at an end of the delivery stroke; means forming a fuel return; and a bypass line branching from said fuel duct between said suction space and said valve and leading to a fuel return so as to prevent a return flow of the fuel from said pump working space to said suction space through said fuel duct.

2. A fuel injection pump as define in claim 1; and further comprising a housing part having a bore hole, said valve being inserted in said bore hole and together with said bore hole defines an annular space which is connected with said bypass line and with said fuel return.

3. A fuel injection pump for internal combustion engines, comprising means forming a suction space; a fuel duct; an electrically actuated valve controlling said fuel duct; a fuel supply tank; a distributor having a distributing opening; a plurality of pressure ducts connectable with injection locations of an internal combustion engine via injection lines; a pump plunger which defines a pump work space connectable with said suction space during a suction stroke and during a control portion of the delivery stroke of said pump plunger via said fuel duct, while fuel is delivered from said fuel supply tank to said suction space connectable during a respective delivery stroke of said pump plunger via said distributor opening, with one of said plurality of pressure ducts, said valve having a closing phase which determines a high pressure fuel delivery into said injection lines; means forming a fuel return; a bypass line provided to a fuel return and branching from said fuel duct between said suction space and said valve; and a cylinder bush which is arranged in said bore hole and define said pump work space at its circumference, said bore hole and said cylinder bush forming therebetween a further annular space which is connected with said suction space on one side and with said valve on the other side, said bypass line branching form said further annular space closing said cylinder bush.

4. A fuel injection pump for internal combustion engines, comprising means forming a suction space; a fuel duct; an electrically actuated valve controlling said fuel duct; a fuel supply tank; a distributor having a distributing opening; a plurality of pressure ducts connectable with injection locations of an itnernal combustion engine via injection lines; a pump plunger which defines a pump work space connectable with said suction space during a suction stroke and during a control portion of the delivery stroke of said pump plunger via said fuel duct, while fuel is delivered from said fuel supply tank to said suction space connectable during a respective delivery stroke of said pump plunger via said distributor opening with one of said plurality of pressure ducts, said valve having a closing phase which determines a high pressure fuel delivery into said injection lines; mans forming a fuel return; a bypass line provided to a fuel return and branching from said duel duct between said suction space and said valve; and a throttle provided downstream of a branching of said bypass line from said fuel duct.

* * * * *